United States Patent [19]

LaBate

[11] 4,350,325

[45] Sep. 21, 1982

[54] PREFABRICATED MULTIPLE DENSITY BLAST FURNACE RUNNER

[76] Inventor: Micheal D. LaBate, 115 Hazen Ave., Ellwood City, Pa. 16117

[21] Appl. No.: 245,087

[22] Filed: Mar. 18, 1981

[51] Int. Cl.[3] ..... F27D 3/14

[52] U.S. Cl. ..... 266/196; 266/236; 266/280

[58] Field of Search ..... 266/196, 236, 280, 281; 193/2 R; 65/324

[56] References Cited

U.S. PATENT DOCUMENTS

| | | | |
|---|---|---|---|
| 3,480,125 | 11/1969 | Ash | 266/196 |
| 3,600,480 | 8/1971 | Parsons | 266/196 |
| 3,863,907 | 2/1975 | Pierson Sr. et al. | 266/196 |
| 4,039,172 | 8/1977 | Yoshida | 266/196 |
| 4,262,885 | 4/1981 | LaBate | 266/236 |

FOREIGN PATENT DOCUMENTS

| | | | |
|---|---|---|---|
| 2025012 | 1/1980 | United Kingdom | 266/281 |

*Primary Examiner*—M. J. Andrews
*Attorney, Agent, or Firm*—Harpman & Harpman

[57] ABSTRACT

A runner for hot metal as from a blast furnace is formed from a series of interconnected modular units which are prefabricated from refractory based materials in layers of different densities resulting in a calculable exposure life determined by the density and the amount and temperature of the molten metal handled by the runner. The modular units are formed from a mixture including aluminum oxide, clay, refractory cement and phosphoric acid that has a known life dicated by the density of compaction of the layers of the material in the finished product.

8 Claims, 3 Drawing Figures

FIG. 1
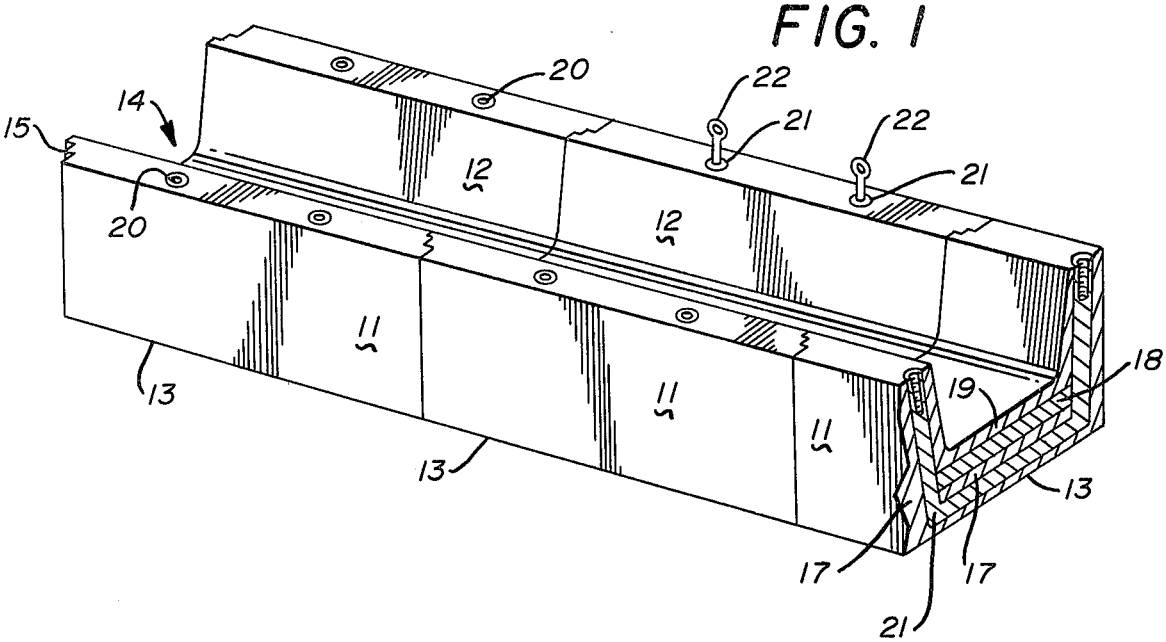
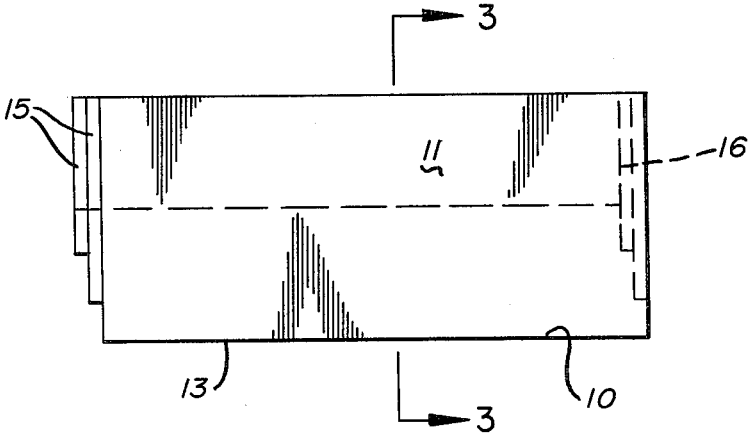
FIG. 2
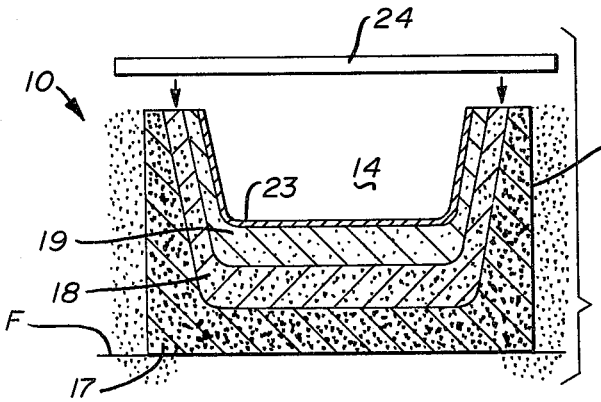
FIG. 3

PREFABRICATED MULTIPLE DENSITY BLAST FURNACE RUNNER

BACKGROUND OF THE INVENTION (1) Field of the Invention

This invention relates to hot metal runners as used in the metal producing industry for delivering molten metal from a source to a remote point. This is a cip of Serial No. 206,287, filed Nov. 12, 1980.

(2) Description of the Prior Art

Runners for handling hot metal are disclosed in U.S. Pat. Nos. 4,039,172, 3,174,739 and 3,600,480.

The runner of U.S. Pat. No. 4,039,172 is a mass of refractory material coalesced under the influence of physical force with metal reinforcement members therein, the refractory material being one selected from those usable for conventional fire bricks such as clay. The metal reinforcement comprises flat bars and angles welded to one another to form a reinforcing skeleton in which the molding material is placed and subjected to physical force. A die is used to contain the reinforcing skeleton and the molding material during the compaction of the material into a coalesced mass of a uniform density throughout.

In the present invention the blast furnace runner unit is formed of layers of refractory material selected from those usable for conventional fire bricks such as clay and a suitable binder with each of the superimposed layers defining a cross sectionally trough-like configuration and of a different density with the first or lowermost layer being comparcted to the greatest density and the successive layers thereon comparcted to progressively lesser densities.

In the runner disclosed in U.S. Pat. No. 3,174,739, a metal shell contains a refractory lining which is formed of a permanent monolithic layer with a semi-permanent layer overlying the monolithic layer except at the discharge or nose end thereof. The semi-permanent layer is formed of magnesite or dolomite. The novelty in the patent relates to a nose formed on the discharge end of the runner of a refractory such as fire clay, crushed fire brick and black pitch with water to form a mortar which is applied as an end or nose over the monolithic layer and the semipermanent layer of the runner. The disclosure therefore includes the metal shell, the two layers of appropriate material, which are not compacted, with the addition of the nose formed of the patching material including the black pitch.

This disclosure differs from the present invention in that there is no suggestion of the multiple layer mass formed of the refractory material with each of the layers being compacted to a different density.

U.S. Pat. No. 3,600,480 relates to a process of repairing runners and incidentally discloses a runner in which the metal engaging uppermost surface termed an inside lining in the patent is formed of a composition of carbon and clay with a so-called outside lining made of silicon-carbide brick with the entire trough-like shape having a base of a still different material. The novelty in the patent relates to a patch applied to a worn away portion of the carbon and clay inside lining, the patch material comprising a mixture of particles of pitch and particles of carbon such as fine coke and pitch, which are noted in the patent as producing the highest density mentioned.

The structure of the runner disclosed is of uniform density as the same is not compacted by force.

In the present invention the hot metal runner discloses the successive layers of compacted materials of different densities with no carbon or pitch in any of the layers as such materials would adversely affect the desired densities of the layers of the hot metal runner.

The prior art runners are therefore primarily of uniform density and with the exception of the disclosure of U.S. Pat. No. 4,039,172, are formed under thermal influence as heretofore customary in the art relating to the formation of refractory articles.

SUMMARY OF THE INVENTION

The present invention relates to a runner for receiving and guiding molten metal from a blast furnace or the like, the runner being formed of prefabricated units incorporating superimposed layers of refractory material of known differing densities compacted to form a desired shape. The use of the runners disclosed herein in forming a desired flow pattern on a pouring floor permits a rapid and relatively easy formation of the complete hot metal runner with the multiple layered units readily indicating their degree of wear and the remaining known life after each pour of metal therethrough due to the different visual characteristics of the layers of different densities of refractory material.

It will thus be seen that the use of the herein disclosed prefabricated multiple density hot metal runner units and the visual determination of their state of wear made possible by their formation enables individual units of a complete runner pattern on a pouring floor to be replaced as necessary between pours to insure the retention of a desirable metal holding and guiding runner throughout a hot metal pour.

In a preferred embodiment as described herein the material of the hot metal runner is formed in the desired shape as by ramming or impaction in a body built up of progressively rammed or packed layers. By maintaining a desired shape of the runner a hard refractory cap can be used to cover the runner and the molten metal therein and thus confine the smoke and fumes and flames normally associated with moving molten metal so that they can be collected at spaced points in a practical manner preventing atmospheric pollution.

DESCRIPTION OF THE DRAWINGS

FIG. 1 is a perspective view of several of the modular runner units assembled in end to end relation with parts of one of the units being broken away and shown in cross section;

FIG. 2 is a side elevation of one of the runner units as seen in FIG. 1; and FIG. 3 is a composite view showing a hot metal runner in cross section embedded in a pouring floor with the multiple layers of different densities in the unit illustrated together with a refractory cap for enclosing the hot metal trough defined by the hot metal runner units.

DESCRIPTION OF THE PREFERRED EMBODIMENT

By referring to the drawings and FIG. 1 in particular, it will be seen that a portion of a hot metal runner has been disclosed as being formed of a plurality of modular units, each of which is generally indicated by the numeral 10 and each of which has substantially vertical spaced sidewalls 11 and 12 and a bottom 13.

As illustrated in FIGS. 1 and 3 of the drawings, each of the runner units 10 is shaped to provide a trough 14 through which molten metal, such as iron from a blast furnace or steel from an open hearth or the like, can be directed. The runner units may be of various practical sizes capable of handling the flow of metal from the tap hole of the furnace and each of the modular runner units 10 is preferably formed with stepped extensions 15 axially thereof which are adapted to register in inwardly stepped shoulders 16 in the opposite end of the adjacent modular runner unit 10. The outwardly stepped extensions 15 and the inwardly stepped shoulders 16 are best illustrated in FIG. 2 of the drawings and by referring again to FIG. 1 of the drawings it will be seen that the end to end alignment of the modular runner unit 10 is defined by the face to face engagement of the stepped extensions 15 and the stepped shoulders 16.

Still referring to FIG. 1 of the drawings, it will be observed that the cross section of the modular runner unit 10 appearing at the right hand portion of FIG. 1 illustrates in exaggerated degree the formation of each of the modular runner units 10 of a plurality of layers of compacted refractory material 17, 18 and 19 respectively with each of the compacted layers 17, 18 and 19 respectively being of different degrees of density as indicated by the difference in the shading in the drawing, the outermost layer 17 being compacted to the greatest density, the intermediate layer 18 being compacted to a density less than that of the outermost layer 17 and the innermost layer 19 being compacted to a density less than the density of the intermediate layer 18.

The compaction of the multiple layers 17, 18 and 19 of the hot metal runner unit 10 by physical force such as ramming or packing produces a mass coalesced capable of shape retention and having a predetermined life expectancy when holding and guiding molten metal directed therethrough.

Still referring to FIG. 1 of the drawings, it will be observed that there are a plurality of openings 20 formed in the upper parallel top edges of the runner units 10 and that fastener formations including ceramic inserts 21 which have a generally U-shaped configuration are embedded within the runners. Eyelet carrying bolts 22 are engaged within the upper ends of the ceramic insert which are apertured and internally threaded so that the individual moldular runner units 20 can be readily handled by mechanical equipment and positioned in end to end relation in establishing a desired path or trough for molten metal.

In FIG. 3 of the drawings, the hot metal engaging surface of the trough 14 is illustrated as having a colloidal graphite coating 23, the colloidal graphite incorporation submicron particle size graphite in a liquid suspension applied to the inner surface of the inner layer 19 of the modular unit 10.

The illustrations in the Figures of the drawings are exaggerated and shaded to indicate the different degrees of compaction of the layers 17, 18 and 19 heretofore described in combination with the different densities in the Figures of the drawings it will be seen that although lines are shown between the multiple layers 17, 18 and 19 of different densities, the actual modular runner unit 10 is formed of refractory based materials such as clay and binders rammed or packed to form a mass coalesced by physical force not under thermal influence and then thermally influenced to chemically set the binders, the mass having the desired multiple layers of different densities.

It has been determined that by first compacting or ramming or otherwise coalescing the material by physical force from which the modular runner units 10 are formed and thereafter heating the same, the runner units are formed in a mass having layers of different degrees of density, and the life of the modular units 10 and the runner trough or path formed of a plurality of such units can be predetermined to match a desired metal conducting time.

A suitable refractory based mixture may comprise 81.5% by weight Mulcoa brand aluminum oxide, which is a mixture having 60% aluminum oxide. To this is added 13.5% raw fire clay and 5% pure aluminum oxide ($AL_2O_3$). This is combined with phosphoric acid ($H_3O_4P$) solution of 50% water and 50% phosphoric acid with the other ingredients in a ratio of 1.14 to 1. In this example 88 lbs. of phosphoric acid solution is added to 100 lbs. of the above combined materials to produce a slurry suitable to be rammed or packed into molds and dried. An alternate mixture is used in runners to receive slag at the end of an iron pour. Due to the increased corrosive properties of slag, a mixture comprising 46% by weight Mulcoa brand aluminum oxide, 31.25% silicon carbide, 10% powdered pure graphite, 12.7% fire clay combined with phosphoric acid solution as a binder in the same ratio as hereinbefore described.

In producing the modular runner unit of the invention, a mold is used to provide the desired shape into which the premixed material is positioned and compacted by physical force in layers to the desired density of each of the layers before baking which sets the binders.

Again referring to FIG. 3 of the drawings, it will be seen that the modular runner unit is shown embedded in a pouring floor F and that a cover block 24 is illustrated, several of which are used to cover the completed runners. The cover block 24 is comprised of a mixture of refractory based materials similar to that of the runners consisting of, but not limited to, 77% by weight of Mulcoa brand refractory mix containing 70% aluminum oxide; 9% fired brick grog containing 40% aluminum oxide; 14% refractory cement. To this is added phosphoric acid ($H_3O_4P$) solution as a binder and stainless steel needles at a rate of 4 lbs. per cubic foot. The addition of the stainless steel needles increases the strength of the article.

The modular runner unit disclosed herein has the additional advantage of providing a heat retaining structure so that runners formed of the units deliver the molten metal with a very small loss of temperature and which action contributes to the rapid flow of molten metal without any pooling or freezing.

It will occur to those skilled in the art that various changes and modifications may be made in the invention disclosed herein without departing from the spirit thereof or from the scope of the appended claims.

Having thus described my invention what I claim is:

1. A hot metal runner unit comprising an elongated troughlike body member having a base and spaced parallel upstanding side sections wherein said runner unit is a multi-layered mass of refractory material comprising a mixture of aluminum oxide, raw fire clay and binders consisting of at least one of a group consisting of phosphoric acid, silicon carbide and powdered graphite in which each layer is coalesced by physical force not under thermal influence with each of said multi-layers being of a different density and having a known predetermined lifetime when subjected to molten metal flowing therethrough.

2. The hot metal runner unit set forth in claim 1 and wherein the refractory material contains brick grog and refractory cement.

3. The hot metal runner unit set forth in claim 1 and wherein the refractory material clay.

4. The hot metal runner unit set forth in claim 1 and wherein the mass of the unit is formed progressively of several layers, each compacted to a different degree of thickness.

5. The hot metal runner unit set forth in claim 1 and wherein a graphite coating is penetrated into the metal receiving areas of said unit and the graphite is applied as a sub-colloidal particle size in a liquid carrier.

6. The hot metal runner unit set forth in claim 1 and wherein the opposite ends of said runner unit are stepped, one end inwardly and one end outwardly, so as to form interengaging configurations on adjacent runner units in axial alignment and engagement.

7. The hot metal runner unit of claim 1 wherein the multilayered mass in which each layer is calesced by physical force, not under thermal influence, is finally subjected to thermal influence to set said binders.

8. The hot metal runner unit of claim 1 wherein stainless steel needles are added to the refractory material.

* * * * *

UNITED STATES PATENT AND TRADEMARK OFFICE

CERTIFICATE OF CORRECTION

PATENT NO. : 4,350,325

DATED : September 21, 1982

INVENTOR(S) : Micheal D. LaBate

It is certified that error appears in the above-identified patent and that said Letters Patent is hereby corrected as shown below:

On the title page, in the abstract, line 9, "dicated" should read -- dictated --.

In Claim 3 the second line thereof should read -- wherein the refractory material is clay --.

Signed and Sealed this

Seventh Day of December 1982

[SEAL]

*Attest:*

GERALD J. MOSSINGHOFF

*Attesting Officer* *Commissioner of Patents and Trademarks*